US008431842B2

(12) United States Patent
Yang

(10) Patent No.: US 8,431,842 B2
(45) Date of Patent: Apr. 30, 2013

(54) SEQUENTIAL SWITCHING DEVICE WITH SURROUNDING DISTINCTIVE JOINT POINTS STRUCTURE

(76) Inventor: Tai-Her Yang, Dzan-Hwa (TW)

( * ) Notice: Subject to any disclaimer, the term of this patent is extended or adjusted under 35 U.S.C. 154(b) by 0 days.

(21) Appl. No.: 12/985,411

(22) Filed: Jan. 6, 2011

(65) Prior Publication Data

US 2012/0175229 A1 Jul. 12, 2012

(51) Int. Cl.
*H01H 9/00* (2006.01)

(52) U.S. Cl.
USPC ..... 200/1 B; 200/5 R

(58) Field of Classification Search ..... 200/1 B, 200/5 R, 16 A–16 D, 237–239, 243, 262–269, 200/275; 218/2, 7, 12–14, 43, 48–50, 123–126
See application file for complete search history.

(56) References Cited

U.S. PATENT DOCUMENTS 5,605,223 A * 2/1997 Gutmann et al. ..... 200/275
5,742,017 A * 4/1998 Perret ..... 218/143
5,841,614 A * 11/1998 Perret ..... 218/143

* cited by examiner

*Primary Examiner* — Amy Cohen Johnson
*Assistant Examiner* — Marina Fishman
(74) *Attorney, Agent, or Firm* — Bacon & Thomas, PLLC

(57) ABSTRACT

The present invention is an innovation about a sequential switching device with surrounding heterogeneous joint points structure, in which the exterior of a middle conductive joint point is surrounded by a heterogeneous external joint point structure, so that a time delay is generated between the two joint points during the sequential OF/OFF operations, so the service life of joint points of a mechanical joint point switch can be prolonged, and the voltage drop and thermal loss of joint point are reduced, especially characterized in that the engagement and stability of joint points are enhanced.

6 Claims, 3 Drawing Sheets

SEQUENTIAL SWITCHING DEVICE WITH SURROUNDING DISTINCTIVE JOINT POINTS STRUCTURE

BACKGROUND OF THE INVENTION (a) Field of the Invention

The present invention relates to a sequential switching device with surrounding heterogeneous joint points structure, in which the exterior of a middle conductive joint point is surrounded by a heterogeneous external joint point structure, so that a time delay is generated between the two joint points during the sequential OF/OFF operations, so the service life of joint points of a mechanical joint point switch can be prolonged, and the voltage drop and thermal loss of joint point are reduced, especially characterized in that the engagement and stability of joint points are enhanced.

(b) Description of the Prior Art

For a conventional switching device utilizing a heterogeneous joint point structure for sequential ON/OFF operations, two heterogeneous joint points are assembled with individual conductive reed and arranged in a parallel structure, so the occupied space is larger and the engagement of joint points is not stable.

SUMMARY OF THE INVENTION

The present invention provides a sequential switching device with surrounding heterogeneous joint points structure, wherein a middle conductive joint point being surrounded by a heterogeneous external conductive joint point and suitable for being applied in a switching device; the arc wearing resistance and electric conductive property of the middle conductive joint point and the external conductive joint point are different, so a time delay is generated while the switching device being operated to ON or OFF, and with the physical property of the conductive joint point, when the switch being engaged (ON), the middle conductive joint point having higher arc wearing resistance is firstly subject to the arc generated during the electric engagement, then the external conductive joint point with lower electric resistance and greater conductibility is subsequently connected in parallel and engaged, and when the switch is disengaged (OFF), the external conductive joint point with lower electric resistance and greater conductibility is firstly released, then the middle conductive joint point having higher arc wearing resistance is served to perform the separation (OFF) and subject to the arc generated during the OFF operation; with the mentioned operation, the voltage drop and thermal loss of the joint points can be reduced, especially characterized in that when the switch is engaged (ON), the external conductive joint point in a surrounding structure can provide a more stable engagement between the joint points.

DESCRIPTION OF MAIN COMPONENT SYMBOLS

Figure 1:
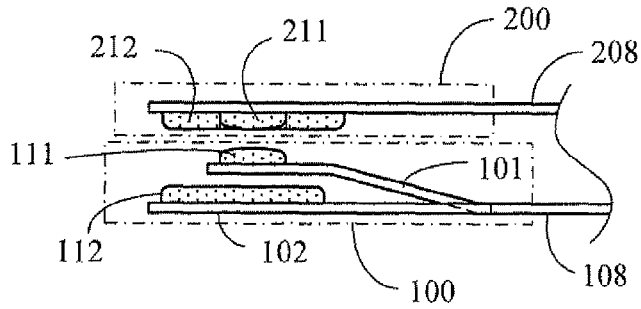
FIG. 1 is a schematic view showing the structural principle of the present invention.

100: First side of switching device
101: Internal reed
102: External surrounding reed
108: Conductive sheet of first side
111: Middle conducive joint point of first side
112: External conductive joint of first side
200: Second side of switching device
201: Internal reed
202: External surrounding reed
208: Conductive sheet of second side
211: Middle conducive joint point of second side
212: External conductive joint of second side

DETAILED DESCRIPTION OF THE PREFERRED EMBODIMENTS

For a conventional switching device utilizing a heterogeneous joint point structure for sequential ON/OFF operations, two heterogeneous joint points are assembled with individual conductive reed and arranged in a parallel structure, so the occupied space is larger and the engagement of joint points is not stable.

The present invention relates to a sequential switching device with surrounding heterogeneous joint points structure, in which the exterior of a middle conductive joint point is surrounded by a heterogeneous external joint point structure, so that a time delay is generated between the two joint points during the sequential ON/OFF operations, so the service life of joint points of a mechanical joint point switch can be prolonged, and the voltage drop and thermal loss of joint point are reduced, especially characterized in that the engagement and stability of joint points are enhanced.

The present invention provides a sequential switching device with surrounding heterogeneous joint points structure, wherein a middle conductive joint point being surrounded by a heterogeneous external conductive joint point and suitable for being applied in a switching device; the arc wearing resistance and electric conductive property of the middle conductive joint point and the external conductive joint point are different, so a time delay is generated while the switching device being operated to ON or OFF, and with the physical property of the conductive joint point, when the switch being engaged (ON), the middle conductive joint point having higher arc wearing resistance is firstly subject to the arc generated during the electric engagement, then the external conductive joint point with lower electric resistance and greater conductibility is subsequently connected in parallel and engaged, and when the switch is disengaged (OFF), the external conductive joint point with lower electric resistance and greater conductibility is firstly released, then the middle conductive joint point having higher arc wearing resistance is served to perform the separation (OFF) and subject to the arc generated during the OFF operation; with the mentioned operation, the voltage drop and thermal loss of the joint points can be reduced, especially characterized in that when the switch is engaged (ON), the external conductive joint point in a surrounding structure can provide a more stable engagement between the joint points.

Figure 2:
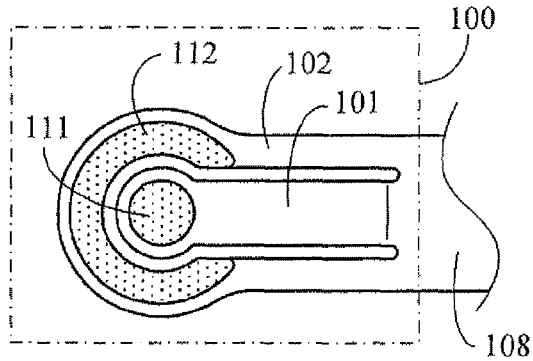
FIG. 2 is a schematic structural view showing the switching device of FIG. 1 wherein the internal reed (101) of the conductive sheet of first side (108) being installed with the middle conductive joint point of first side (111) and the external surrounding reed (102) being installed with the external conductive joint point of first side (112) so as to assemble the first side of switching device (100).

Referring to FIG. 1, which is a schematic view showing the structural principle of the present invention;

Referring to FIG. 2, which is a schematic structural view showing the switching device of FIG. 1 wherein the internal reed (101) of the conductive sheet of first side (108) being installed with the middle conductive joint point of first side (111) and the external surrounding reed (102) installed with the external conductive joint point of first side (112) so as to assemble the first side of switching device (100).

Figure 3:
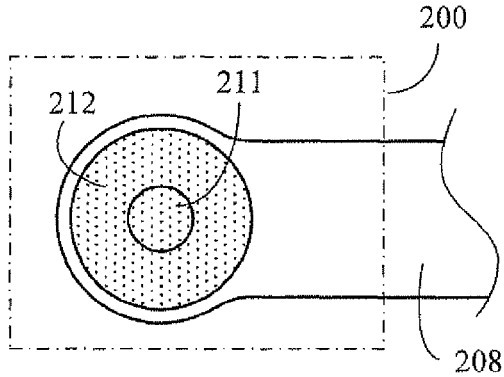
FIG. 3 is a schematic structural view showing the switching device of FIG. 1 wherein the conductive sheet of second side (208) being installed with the middle conductive joint point of second side (211) and the external conductive joint point of second side (212) so as to assemble the second side of switching device (200).

Referring to FIG. 3, which is a schematic structural view showing the switching device of FIG. 1 wherein the conductive sheet of second side (208) being installed with the middle conductive joint point of second side (211) and the external conductive joint point of second side (212) so as to assemble the second side of switching device (200).

As shown in FIG. 1, FIG. 2 and FIG. 3, it mainly consists of:

Conductive sheet of first side (108): made of a material with properties of electric conductivity and elasticity, and installed with an extended internal reed (101) and an external surrounding reed (102) surrounding the periphery of the internal reed (101), and wherein the internal reed (101) is provided with elasticity with respect to the external surrounding reed (102), the internal reed (101) is installed with a middle conductive joint point of first side (111), and the external surrounding reed (102) is installed with an external conductive joint point of first side (112), thereby the two joints commonly constitute the first side of switching device (100) to perform ON/OFF operations with a second side of switching device (200), wherein:

The middle conductive joint point of first side (111): constituted by one or more than one electric conductive joint points made of a material having higher arc wearing resistance and/or higher resistance coefficient and/or greater hardness and better anti-wearing property compared to the external conductive joint point of first side (112);

The external conductive joint point of first side (112): constituted by one or more than one electric conductive joint points made of a material having lower resistance coefficient and greater conductibility compared to the middle conductive joint point of first side (111);

Conductive sheet of second side (208): made of a material having properties of electric conductivity and elasticity, and installed with a middle conductive joint point of second side (211) and an external conductive joint point of second side (212) surrounding the periphery of the middle conductive joint point of second side (211);

Middle conductive joint point of second side (211): constituted by one or more than one electric conductive joint points made of a material having higher arc wearing resistance and/or higher resistance coefficient and/or greater hardness and better anti-wearing property compared to the external conductive joint point of second side (212);

The external conductive joint point of second side (212): constituted by one or more than one electric conductive joint points made of a material having lower resistance coefficient and greater conductibility compared to the middle conductive joint point of second side (211);

The distance between the middle conductive joint point of first side (111) and the middle conductive joint point of second side (211) is shorter; the distance between the external conductive joint point of first side (112) and the external conductive joint point of second side (212) is longer.

Figure 4:
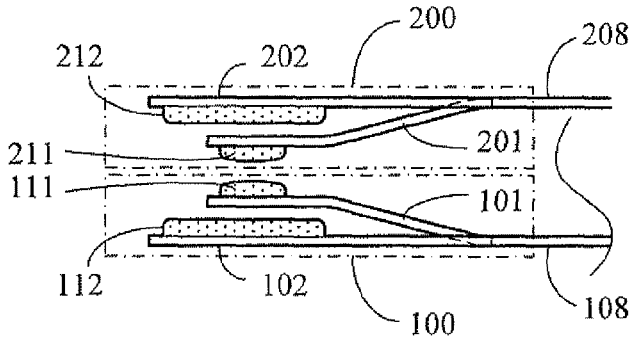
FIG. 4 is a schematic view showing the internal reed (201) of the conductive sheet of first side (108) being installed with the middle conductive joint point of first side (111) and the external surrounding joint point of first side (112) for assembling the first side of switching device (100), and the internal reed (201) of the conductive sheet of second side (208) being installed with the middle conductive joint point of second side (211) and the external surrounding joint point of second side (212) for assembling the second side of switching device (200), according to one embodiment of the present invention.
Figure 5:
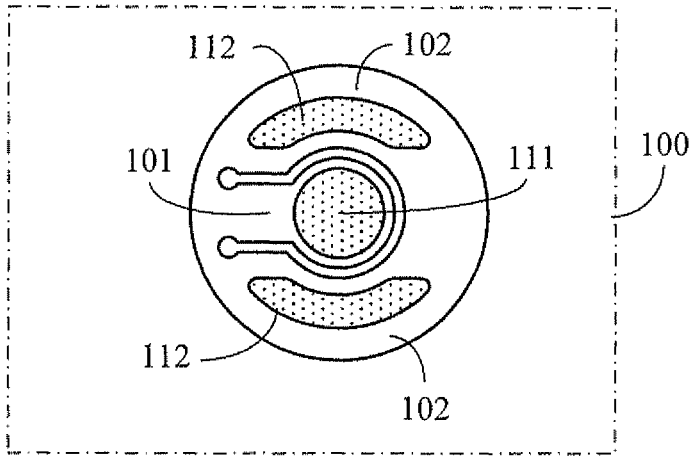
FIG. 5 is a structural schematic view showing the conductive sheet of first side (108) of the switching device being installed with the internal reed (101) oppositely extending in a tongue-like shape and the external conductive joint point of first side (112), as well as the external surrounding reed (102) enclosing the exterior thereof and the middle conductive joint point of first side (111) for assembling the first side of switching device (100).

When the operation of engaging for electric conduction (ON) is performed, the engagement process of the first side of switching device (100) and the second side of switching device (200) is that: the middle conductive joint point of first side (111) of the switching device is firstly in contact with the middle conductive joint point of second side (211) of the switching device, then the external conductive joint point of first side (112) of the switching device and the external conductive joint point of second side (212) of the switching device are in contact;

When the operation of separating for termination (OFF) is performed, the separation process of the first side of switching device (100) and the second side of switching device (200) is that: the external conductive joint point of first side (112) is firstly disengaged from the external conductive joint point of second side (212), then the middle conductive joint point of first side (111) is disengaged from the middle conductive joint point of second side (211);

According to the present invention, the sequential switching device with surrounding heterogeneous joint points structure can be further provided with a second side of switching device (200) having the same structure as the first side of switching device (100); referring to FIG. 4, which is a schematic view showing the internal reed (201) of the conductive sheet of first side (108) being installed with the middle conductive joint point of first side (111) and the external surrounding joint point of first side (112) for assembling the first side of switching device (100), and the internal reed (201) of the conductive sheet of second side (208) being installed with the middle conductive joint point of second side (211) and the external surrounding joint point of second side (212) for assembling the second side of switching device (200), according to one embodiment of the present invention;

As shown in FIG. 4, a conductive sheet of first side (108) is provided, and the conductive sheet of first side (108) is installed with an internal reed (101) on which an external conductive joint point of first side (112) is installed, and an external surrounding reed (102) on which a middle conductive joint point of first side (111) is installed so as to structure the first side of switching device (100); the second side of switching device (200) is installed with a conductive sheet of second side (208), and the conductive sheet of second side (208) is provided with an internal reed (201) on which a middle conductive joint point of second side (211) is installed, and an external surrounding reed (202) on which an external conductive joint point of second side (212) is installed so as to structure the second side of switching device (200); and the distance relations between the middle conductive joint point of first side (111) and the middle conductive joint point of second side (211) and between the external conductive joint point of first side (112) and the external conductive joint point of second side (212) are that: the distance between the middle conductive joint point of first side (111) and the middle conductive joint point of second side (211) is shorter, while the distance between the external conductive joint point of first side (112) and the external conductive joint point of second side (212) is longer;

According to the present invention, without altering the foundational theory, the sequential switching device with surrounding heterogeneous joint points structure may have applied alternative structures as followings:

In the sequential switching device with surrounding heterogeneous joint points structure, the first side of switching device (100) is that the external surrounding reed (102) is structured to be in a closed circular or rectangular shape and encloses the internal reed (101), a notch is formed between the external surrounding reed (102) and the internal reed (101) extending towards the opposite direction in a tongue-like shape, the distal portion of the notch is in a sealed state, so the external surrounding reed (102) is provided with elasticity with respect to the internal reed (101); referring to FIG. 5, which is a structural schematic view showing the conductive sheet of first side (108) of the switching device being installed with the internal reed (101) oppositely extending in a tongue-like shape and the external conductive joint point of first side (112), as well as the external surrounding reed (102) enclosing the exterior thereof and the middle conductive joint point of first side (111) for assembling the first side of switching device (100).

Figure 6:
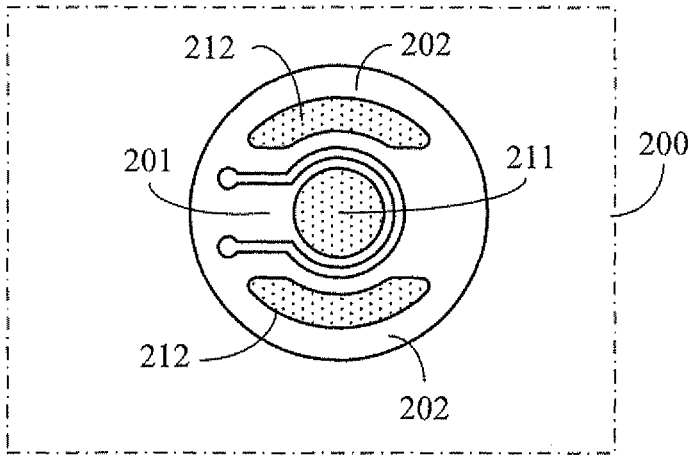
FIG. 6 is a structural schematic view showing the conductive sheet of second side (208) of the switching device being installed with the internal reed (201) oppositely extending in a tongue-like shape and the external conductive joint point of second side (212), as well as the external surrounding reed (202) enclosing the exterior thereof and the middle conductive joint point of second side (211) for assembling the second side of switching device (200).

In the sequential switching device with surrounding heterogeneous joint points structure, the second side of switching device (200) is that the external surrounding reed (202) is designed to be in a closed circular or rectangular shape and encloses the internal reed (201), a notch is formed between the external surrounding reed (202) and the internal reed (201) extending towards the opposite direction in a tongue-like shape, the distal portion of the notch is in a sealed state, so the external surrounding reed (202) is provided with elasticity with respect to the internal reed (201); and structured by the internal reed (201) oppositely and inwardly extending and the external conductive joint point of second side (212), and the external surrounding reed (202) enclosing at the periphery, and the middle conductive joint point of second side (211); referring to FIG. 6, which is a structural schematic view showing the conductive sheet of second side (208) of the switching device being installed with the internal reed (201) oppositely extending in a tongue-like shape and the external conductive joint point of second side (212), as well as the external surrounding reed (202) enclosing the exterior thereof and the middle conductive joint point of second side (211) for assembling the second side of switching device (200).

Figure 7:
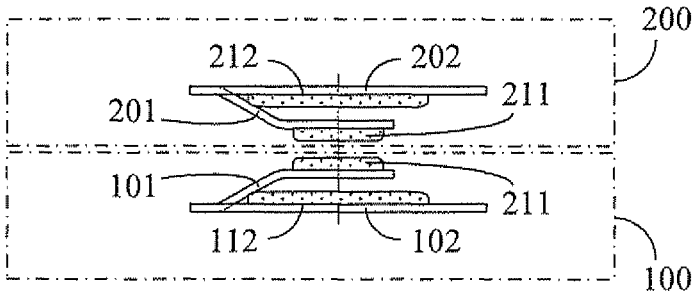
FIG. 7 is a schematic view showing the structure assembled by FIG. 5 and FIG. 6.
Figure 8:
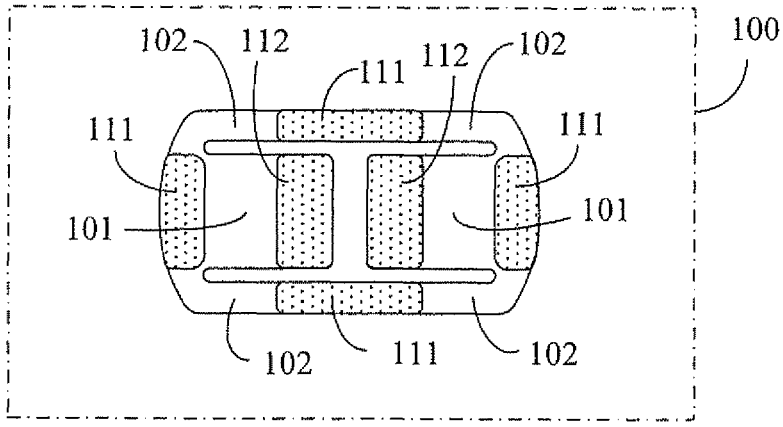
FIG. 8 is a structural schematic view showing the conductive sheet of first side (108) of the switching device being installed with the internal reeds (101) independently extending from opposite direction towards the center but not in contact with each other, and the external conductive joint points of first side (112), as well as the external surrounding reeds (102) enclosing the exterior thereof and the middle conductive joints point of first side (111) for assembling the first side of switching device (100).

Referring to FIG. 7, which is a schematic view showing the structure assembled by FIG. 5 and FIG. 6;

As shown in FIG. 7, it mainly consists of:

the distance relations between the middle conductive joint point of first side (111) and the middle conductive joint point of second side (211) and between the external conductive joint point of first side (112) and the external conductive joint point of second side (212) are that:

the distance between the middle conductive joint point of first side (111) and the middle conductive joint point of second side (211) is shorter, while the distance between the external conductive joint point of first side (112) and the external conductive joint point of second side (212) is longer;

The middle conductive joint point of first side (111) and the middle conductive joint point of second side (211) are structured by middle conductive joint points having higher arc wearing resistance;

The external conductive joint point of first side (112) and the external conductive joint point of second side (212) are structured by external conductive joint points having lower electric resistance and greater conductibility;

When the operation of engaging for electric conduction (ON) is performed, the engagement process of the first side of switching device (100) and the second side of switching device (200) is that: the middle conductive joint point of first side (111) of the switching device is firstly in contact with the middle conductive joint point of second side (211) of the switching device, then the external conductive joint point of first side (112) of the switching device and the external conductive joint point of second side (212) of the switching device are in contact;

When the operation of separating for termination (OFF) is performed, the separation process of the first side of switching device (100) and the second side of switching device (200) is that: the external conductive joint point of first side (112) is firstly released from the external conductive joint point of second side (212), then the middle conductive joint point of first side (111) is released from the middle conductive joint point of second side (211);

According to the present invention of the sequential switching device with surrounding heterogeneous joint points structure, the external surrounding reed (102) installed on the conductive sheet of first side (108) of the switching device is designed to be in a closed circular or rectangular shape, and the conductive sheet of first side (108) is structured by at least two internal reeds (101) being individually extended from opposite ends in the interior of the external surrounding reed (102) towards the center but not in contact with each other, and the external conductive joint points of first side (112), as well as the external surrounding reed (102) enclosing the exterior thereof and the middle conductive joint points of first side (111); the root of the internal reeds (101) connected to the conductive sheet of first side (108) are connected with the external surrounding reed (102), two ends of each internal reed (101) and the external surrounding reed (102) form a notch, so that the internal reed (101) is provided with elasticity with respect to the external surrounding reed (102); referring to FIG. 8, which is a structural schematic view showing the conductive sheet of first side (108) of the switching device being installed with the internal reeds (101) independently extending from opposite direction towards the center but not in contact with each other, and the external conductive joint points of first side (112), as well as the external surrounding reeds (102) enclosing the exterior thereof and the middle conductive joints point of first side (111) for assembling the first side of switching device (100).

Figure 9:
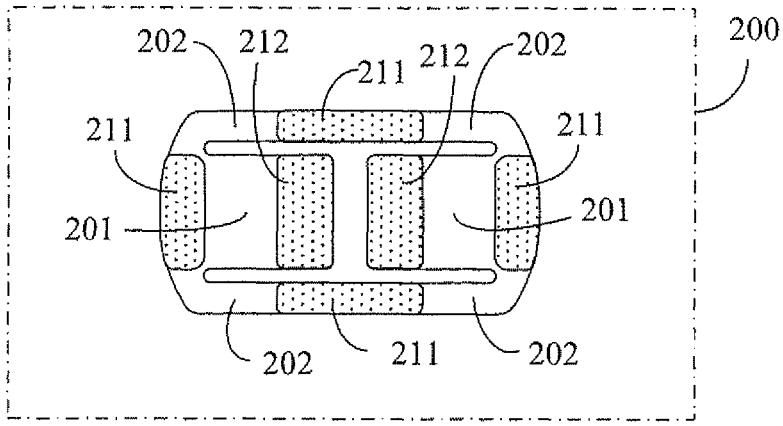
FIG. 9 is a structural schematic view showing the conductive sheets of second side (208) of the switching device being installed with the internal reeds (201) independently extending from opposite direction towards the center but not in contact with each other, and the external conductive joint points of second side (212), as well as the external surrounding reeds (202) enclosing the exterior thereof and the middle conductive joint points of second side (211) for assembling the second side of switching device (200).
Figure 10:
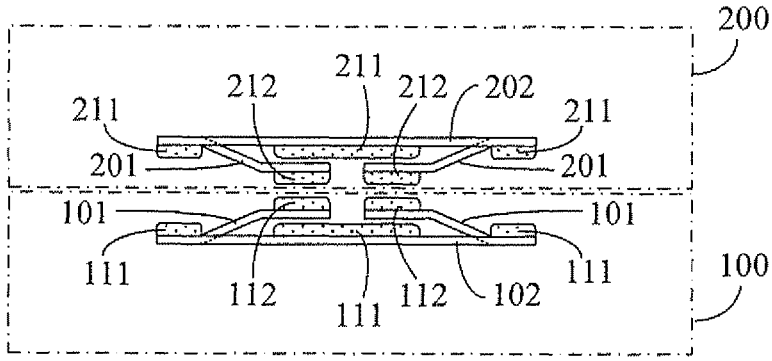
FIG. 10 is a schematic view showing the structure assembled by FIG. 8 and FIG. 9.

According to the present invention of the sequential switching device with surrounding heterogeneous joint points structure, the external surrounding reed (202) installed on the conductive sheet of second side (208) of the switching device is designed to be in a closed circular or rectangular shape, and the conductive sheet of second side (208) is structured by at least two internal reeds (201) being individually extended from opposite ends in the interior of the external surrounding reed (202) towards the center but not in contact with each other, and the external conductive joint points of second side (212), as well as the external surrounding reed (202) enclosing the exterior thereof and the middle conductive joint points of second side (211), the root of the internal reeds (201) connected to the conductive sheet of second side (208) are connected with the external surrounding reed (202), two ends of each internal reed (201) and the external surrounding reed (202) form a notch, so that the internal reed (201) is provided with elasticity with respect to the external surrounding reed (202); referring to FIG. 9, which is a structural schematic view showing the conductive sheets of second side (208) of the switching device being installed with the internal reeds (201) independently extending from opposite direction towards the center but not in contact with each other, and the external conductive joint points of second side (212), as well as the external surrounding reeds (202) enclosing the exterior thereof and the middle conductive joint points of second side (211) for assembling the second side of switching device (200);

Referring to FIG. 10, which is a schematic view showing the structure assembled by FIG. 8 and FIG. 9;

As shown in FIG. 10, it mainly consists of:

the distance relations between the middle conductive joint point of first side (111) and the middle conductive joint point of second side (211) and between the external conductive joint point of first side (112) and the external conductive joint point of second side (212) are that:

the distance between the middle conductive joint point of first side (111) and the middle conductive joint point of second side (211) is shorter, while the distance between the external conductive joint point of first side (112) and the external conductive joint point of second side (212) is longer;

The middle conductive joint point of first side (111) and the middle conductive joint point of second side (211) are structured by middle conductive joint points having higher arc wearing resistance;

The external conductive joint point of first side (112) and the external conductive joint point of second side (212) are structured by external conductive joint points having lower electric resistance and greater conductibility;

When the operation of engaging for electric conduction (ON) is performed, the engagement process of the first side of switching device (100) and the second side of switching device (200) is that: the middle conductive joint point of first side (111) of the switching device is firstly in contact with the middle conductive joint point of second side (211) of the switching device, then the external conductive joint point of first side (112) of the switching device and the external conductive joint point of second side (212) of the switching device are in contact;

When the operation of separating for termination (OFF) is performed, the separation process of the first side of switching device (100) and the second side of switching device (200) is that: the external conductive joint point of first side (112) is firstly released from the external conductive joint point of second side (212), then the middle conductive joint point of first side (111) is released from the middle conductive joint point of second side (211);

According to the present invention, without altering the foundational theory, the sequential switching device with surrounding heterogeneous joint points structure may have applied alternative structures as followings:

According to the present invention of the sequential switching device with surrounding heterogeneous joint points structure, the middle conductive joint point of first side (111), the external conductive joint point of first side (112), the middle conductive joint point of second side (211) and the external conductive joint point of second side (212) can be structure by one or more than one electric conductive joint points.

According to the present invention of the sequential switching device with surrounding heterogeneous joint points structure, the middle conductive joint point of first side (111), the external conductive joint point of first side (112), the middle conductive joint point of second side (211) and the external conductive joint point of second side (212) have different electric conductive properties, wherein the middle conductive joint point of first side (111) and the middle conductive joint point of second side (211) are made of materials having higher arc wearing resistance and/or higher electric resistance coefficient and/or greater hardness and better anti-wearing property, and the distance between the middle conductive joint point of first side (111) and the middle conductive joint point of second side (211) is shorter;

While the external conductive joint point of first side (112) and the external conductive joint point of second side (212) are made of materials having lower electric resistance and greater conductibility, and the distance between the external conductive joint point of first side (112) and the external conductive joint point of second side (212) is longer.

According to the present invention of the sequential switching device with surrounding heterogeneous joint points structure, the middle conductive joint point of first side (111) and the middle conductive joint point of second side (211), and the external conductive joint point of first side (112) and the external conductive joint point of second side (212) have different electric conductive properties, wherein the middle conductive joint point of first side (111) and the middle conductive joint point of second side (211) are made of materials having lower electric resistance and greater conductibility, and the distance between the middle conductive joint point of first side (111) and the middle conductive joint point of second side (211) is longer;

While the external conductive joint point of first side (112) and the external conductive joint point of second side (212) are made of materials having higher arc wearing resistance and/or higher electric resistance coefficient and/or greater hardness and better anti-wearing property, and the distance between the external conductive joint point of first side (112) and the external conductive joint point of second side (212) is shorter.

According to the present invention, the sequential switching device with surrounding heterogeneous joint points structure can be applied in one or more than one of the following switching devices including a no fuse breaker (NFB), manually operated switch, electromagnetically controlled switch, oil pressure controlled switch, pneumatic controlled switch, mechanically controlled switch, or magnetic reed switch.

The invention claimed is:

1. A sequential switching device with surrounding heterogeneous joint points structure, wherein a middle conductive joint point is surrounded by a heterogeneous external conductive joint point and suitable for being applied in a switching device; the arc wearing resistance and electric conductive property of the middle conductive joint point and the external conductive joint point are different, so a time delay is generated while the switching device is operated to ON or OFF, and when the switching device is engaged (ON), the middle conductive joint point having a higher arc wearing resistance is firstly subject to the arc generated during the electric engagement, and then the external conductive joint point with lower electric resistance and greater conductivity is subsequently connected in parallel and engaged, and when the switch is disengaged (OFF), the external conductive joint point with lower electric resistance and greater conductivity is firstly released, and then the middle conductive joint point having higher arc wearing resistance is performs the separation (OFF) and is subject to the arc generated during the OFF operation as a result of which, the voltage drop and thermal loss of the joint points is reduced, characterized in that when the switch is engaged (ON), the external conductive joint point in a surrounding structure provides a more stable engagement between the joint points, and the switching device comprises:

a conductive sheet of a first side (108): made of a material with properties of electric conductivity and elasticity, and installed with an extended internal reed (101) and an external surrounding reed (102) surrounding the periphery of the internal reed (101), and wherein the internal reed (101) is provided with elasticity with respect to the external surrounding reed (102), the internal reed (101) is installed with a middle conductive joint point of said first side (111), and the external surrounding reed (102) is installed with an external conductive joint point of said first side (112), thereby the two joints commonly constitute the first side of switching device (100) to perform ON/OFF operations with a second side of switching device (200);

the middle conductive joint point of said first side (111): constituted by one or more than one electric conductive joint points made of a material having higher arc wearing resistance and/or higher resistance coefficient and/or greater hardness and better anti-wearing property compared to the external conductive joint point of said first side (112);

the external conductive joint point of said first side (112): constituted by one or more than one electric conductive joint points made of a material having lower resistance coefficient and greater conductivity compared to the middle conductive joint point of said first side (111);

a conductive sheet of a second side (208): made of a material having properties of electric conductivity and elasticity, and installed with a middle conductive joint point of said second side (211) and an external conductive joint point of said second side (212) surrounding the periphery of the middle conductive joint point of said second side (211);

the middle conductive joint point of said second side (211): constituted by one or more than one electric conductive joint points made of a material having higher arc wearing resistance and/or higher resistance coefficient and/or greater hardness and better anti-wearing property compared to the external conductive joint point of said second side (212);

the external conductive joint point of said second side (212): constituted by one or more than one electric conductive joint points made of a material having lower resistance coefficient and greater conductivity compared to the middle conductive joint point of said second side (211);

wherein the distance between the middle conductive joint point of said first side (111) and the middle conductive joint point of said second side (211) is shorter; and the distance between the external conductive joint point of said first side (112) and the external conductive joint point of said second side (212) is longer;

wherein when the operation of engaging for electric conduction (ON) is performed, the engagement process of the first side of switching device (100) and the said second side of switching device (200) is that: the middle conductive joint point of said first side (111) of the first side of switching device is firstly in contact with the middle conductive joint point of said second side (211) of the second side of switching device, then the external conductive joint point of said first side (112) of the first side of switching device and the external conductive joint point of said second side (212) of the second side of switching device are in contact;

wherein when the operation of separating for termination (OFF) is performed, the separation process of the first side of switching device (100) and the second side of switching device (200) is that: the external conductive joint point of said first side (112) is firstly disengaged from the external conductive joint point of said second side (212), then the middle conductive joint point of said first side (111) is disengaged from the middle conductive joint point of said second side (211);

wherein on the first side of switching device (100), the external surrounding reed (102) is structured to be in a closed circular or rectangular shape and encloses the internal reed (101), a notch is formed between the external surrounding reed (102) and the internal reed (101) extending towards the opposite direction in a tongue-like shape, and the distal portion of the notch is in a sealed state, so the external surrounding reed (102) is provided with elasticity with respect to the internal reed (101);

wherein on the second side of switching device (200), the external surrounding reed (202) is structured to be in a closed circular or rectangular shape and encloses the internal reed (201), a notch is formed between the external surrounding reed (202) and the internal reed (201) extending towards the opposite direction in a tongue-like shape, and the distal portion of the notch is in a sealed state, so the external surrounding reed (202) is provided with elasticity with respect to the internal reed (201) and the internal reed (201) is inwardly and oppositely extending from the external reed (202);

wherein the distance relations between the middle conductive joint point of said first side (111) and the middle conductive joint point of said second side (211) and between the external conductive joint point of said first side (112) and the external conductive joint point of said second side (212) are that:

the distance between the middle conductive joint point of said first side (111) and the middle conductive joint point of said second side (211) is shorter, while the distance between the external conductive joint point of said first side (112) and the external conductive joint point of said second side (212) is longer;

wherein the middle conductive joint point of said first side (111) and the middle conductive joint point of said second side (211) are structured by middle conductive joint points having higher arc wearing resistance;

wherein the external conductive joint point of said first side (112) and the external conductive joint point of said second side (212) are structured by external conductive joint points having lower electric resistance and greater conductivity;

wherein when the operation of engaging for electric conduction (ON) is performed, the engagement process of the first side of switching device (100) and the second side of switching device (200) is that: the middle conductive joint point of said first side (111) of the switching device is firstly in contact with the middle conductive joint point of said second side (211) of the switching device, and then the external conductive joint point of said first side (112) of the switching device and the external conductive joint point of said second side (212) of the switching device are in contact; and wherein when the operation of separating for termination (OFF) is performed, the separation process of the first side of switching device (100) and the second side of switching device (200) is that: the external conductive joint point of said first side (112) is firstly released from the external conductive joint point of said second side (212), and then the middle conductive joint point of said first side (111) is released from the middle conductive joint point of said second side (211).

2. The sequential switching device with surrounding heterogeneous joint points structure as claimed in claim 1, further comprising second side of switching device (200) having a same structure as the first side of switching device (100), in which a conductive sheet of said first side (108) is provided, and the conductive sheet of said first side (108) is installed with an internal reed (101) on which an external conductive joint point of said first side (112) is installed, and an external surrounding reed (102) on which a middle conductive joint point of said first side (111) is installed so as to structure the first side of switching device (100); the second side of switching device (200) is installed with a conductive sheet of said second side (208), and the conductive sheet of said second side (208) is provided with an internal reed (201) on which a middle conductive joint point of said second side (211) is installed, and an external surrounding reed (202) on which an external conductive joint point of said second side (212) is installed so as to structure the second side of switching device (200).

3. The sequential switching device with surrounding heterogeneous joint points structure as claimed in claim 1, wherein the switching device is applied in one or more than one of the following switching devices: a no fuse breaker (NFB), a manually operated switch, an electromagnetically controlled switch, an oil pressure controlled switch, a pneumatic controlled switch, a mechanically controlled switch, and a magnetic reed switch.

4. A sequential switching device with surrounding heterogeneous joint points structure, wherein a middle conductive joint point is surrounded by a heterogeneous external conductive joint point and suitable for being applied in a switching device; the arc wearing resistance and electric conductive property of the middle conductive joint point and the external conductive joint point are different, so a time delay is generated while the switching device is operated to ON or OFF, and when the switching device is engaged (ON), the middle conductive joint point having a higher arc wearing resistance is firstly subject to the arc generated during the electric engagement, and then the external conductive joint point with lower electric resistance and greater conductivity is subsequently connected in parallel and engaged, and when the switch is disengaged (OFF), the external conductive joint point with lower electric resistance and greater conductivity is firstly released, and then the middle conductive joint point having higher arc wearing resistance is performs the separation (OFF) and is subject to the arc generated during the OFF operation as a result of which, the voltage drop and thermal loss of the joint points is reduced, characterized in that when the switch is engaged (ON), the external conductive joint point in a surrounding structure provides a more stable engagement between the joint points, and the switching device comprises:

a conductive sheet of a first side (108): made of a material with properties of electric conductivity and elasticity, and installed with an extended internal reed (101) and an external surrounding reed (102) surrounding the periphery of the internal reed (101), and wherein the internal reed (101) is provided with elasticity with respect to the external surrounding reed (102), the internal reed (101) is installed with a middle conductive joint point of said first side (111), and the external surrounding reed (102) is installed with an external conductive joint point of said first side (112), thereby the two joints commonly constitute the first side of switching device (100) to perform ON/OFF operations with a second side of switching device (200);

the middle conductive joint point of said first side (111): constituted by one or more than one electric conductive joint points made of a material having higher arc wearing resistance and/or higher resistance coefficient and/or greater hardness and better anti-wearing property compared to the external conductive joint point of said first side (112);

the external conductive joint point of said first side (112): constituted by one or more than one electric conductive joint points made of a material having lower resistance coefficient and greater conductivity compared to the middle conductive joint point of said first side (111);

a conductive sheet of a second side (208): made of a material having properties of electric conductivity and elasticity, and installed with a middle conductive joint point of said second side (211) and an external conductive joint point of said second side (212) surrounding the periphery of the middle conductive joint point of said second side (211);

the middle conductive joint point of said second side (211): constituted by one or more than one electric conductive joint points made of a material having higher arc wearing resistance and/or higher resistance coefficient and/or greater hardness and better anti-wearing property compared to the external conductive joint point of said second side (212);

the external conductive joint point of said second side (212): constituted by one or more than one electric conductive joint points made of a material having lower resistance coefficient and greater conductivity compared to the middle conductive joint point of said second side (211);

wherein the distance between the middle conductive joint point of said first side (111) and the middle conductive joint point of said second side (211) is shorter; and the distance between the external conductive joint point of said first side (112) and the external conductive joint point of said second side (212) is longer;

wherein when the operation of engaging for electric conduction (ON) is performed, the engagement process of the first side of switching device (100) and the second side of switching device (200) is that: the middle conductive joint point of said first side (111) of the first side of switching device is firstly in contact with the middle conductive joint point of said second side (211) of the second side of switching device, then the external conductive joint point of said first side (112) of the first side of switching device and the external conductive joint point of said second side (212) of the second side of switching device are in contact;

wherein when the operation of separating for termination (OFF) is performed, the separation process of the first side of switching device (100) and the second side of switching device (200) is that: the external conductive joint point of said first side (112) is firstly disengaged from the external conductive joint point of said second side (212), then the middle conductive joint point of first side (111) is disengaged from the middle conductive joint point of said second side (211);

wherein the external surrounding reed (102) installed on the conductive sheet of said first side (108) of the switching device is structured to be in a closed circular or rectangular shape, and the conductive sheet of said first side (108) is structured by at least two internal reeds (101) being individually extended from opposite ends in the interior of the external surrounding reed (102) towards the center but not in contact with each other, and the external conductive joint points of said first side (112) as well as the external surrounding reed (102) enclosing the exterior thereof and the middle conductive joint points of said first side (111); the root of the internal reeds (101) connected to the conductive sheet of said first side (108) are connected with the external surrounding reed (102), and two ends of each internal reed (101) and the external surrounding reed (102) form a notch, so that the internal reed (101) is provided with elasticity with respect to the external surrounding reed (102);

the external surrounding reed (202) installed on the conductive sheet of said second side (208) of the switching device is structured to be in a closed circular or rectangular shape, and the conductive sheet of said second side (208) is structured by at least two internal reeds (201) being individually extended from opposite ends in the interior of the external surrounding reed (202) towards the center but not in contact with each other, and the external conductive joint points of said second side (212), as well as the external surrounding reed (202) enclosing the exterior thereof and the middle conductive joint points of said second side (211), the root of the internal reeds (201) connected to the conductive sheet of said second side (208) are connected with the external surrounding reed (202), and two ends of each internal reed (201) and the external surrounding reed (202) form a notch, so that the internal reed (201) is provided with elasticity with respect to the external surrounding reed (202);

the distance relations between the middle conductive joint point of said first side (111) and the middle conductive joint point of said second side (211) and between the external conductive joint point of said first side (112) and the external conductive joint point of said second side (212) are that:

the distance between the middle conductive joint point of said first side (111) and the middle conductive joint point of said second side (211) is shorter, while the distance between the external conductive joint point of said first side (112) and the external conductive joint point of said second side (212) is longer;

the middle conductive joint point of said first side (111) and the middle conductive joint point of said second side (211) are structured by middle conductive joint points having higher arc wearing resistance;

the external conductive joint point of said first side (112) and the external conductive joint point of said second side (212) are structured by external conductive joint points having lower electric resistance and greater conductibility;

wherein when the operation of engaging for electric conduction (ON) is performed, the engagement process of the said first side of switching device (100) and the second side of switching device (200) is that: the middle conductive joint point of said first side (111) of the switching device is firstly in contact with the middle conductive joint point of said second side (211) of the switching device, then the external conductive joint point of said first side (112) of the switching device and the external conductive joint point of said second side (212) of the switching device are in contact; and wherein when the operation of separating for termination (OFF) is performed, the separation process of the first side of switching device (100) and the second side of switching device (200) is that: the external conductive joint point of said first side (112) is firstly released from the external conductive joint point of said second side (212), then the middle conductive joint point of said first side (111) is released from the middle conductive joint point of said second side (211).

5. The sequential switching device with surrounding heterogeneous joint points structure as claimed in claim 4, further comprising second side of switching device (200) having a same structure as the first side of switching device (100), in which a conductive sheet of said first side (108) is provided, and the conductive sheet of said first side (108) is installed with an internal reed (101) on which an external conductive joint point of said first side (112) is installed, and an external surrounding reed (102) on which a middle conductive joint point of said first side (111) is installed so as to structure the first side of switching device (100); the second side of switching device (200) is installed with a conductive sheet of said second side (208), and the conductive sheet of said second side (208) is provided with an internal reed (201) on which a middle conductive joint point of said second side (211) is installed, and an external surrounding reed (202) on which an external conductive joint point of said second side (212) is installed so as to structure the second side of switching device (200).

6. The sequential switching device with surrounding heterogeneous joint points structure as claimed in claim 4, wherein the switching device is applied in one or more than one of the following switching devices: a no fuse breaker (NFB), a manually operated switch, an electromagnetically controlled switch, an oil pressure controlled switch, a pneumatic controlled switch, a mechanically controlled switch, and a magnetic reed switch.

* * * * *